US008422924B2

(12) United States Patent
Imamura et al.

(10) Patent No.: US 8,422,924 B2
(45) Date of Patent: Apr. 16, 2013

(54) IMAGE FORMING APPARATUS INCLUDING TRANSFER ROLLER WITH CONCAVE PORTION AND IMAGE FORMING METHOD

(75) Inventors: Atsushi Imamura, Nagano (JP); Yujiro Nomura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 346 days.

(21) Appl. No.: 12/887,770

(22) Filed: Sep. 22, 2010

(65) Prior Publication Data

US 2011/0081172 A1 Apr. 7, 2011

(30) Foreign Application Priority Data

Oct. 7, 2009 (JP) ..... 2009-233500

(51) Int. Cl.
*G03G 15/01* (2006.01)

(52) U.S. Cl.
USPC ..... 399/304

(58) Field of Classification Search ..... 399/302–304, 399/313
See application file for complete search history.

(56) References Cited

U.S. PATENT DOCUMENTS

| | | | | |
|---|---|---|---|---|
| 5,745,829 | A * | 4/1998 | Gazit et al. | 399/302 |
| 6,389,242 | B1 | 5/2002 | Watanabe | |
| 6,760,565 | B2 | 7/2004 | Watanabe et al. | |
| 8,023,849 | B2 * | 9/2011 | Kamijo | 399/304 |
| 8,145,107 | B2 * | 3/2012 | Tanaka et al. | 399/304 |
| 8,254,818 | B2 * | 8/2012 | Chiba et al. | 399/304 |

FOREIGN PATENT DOCUMENTS

JP 2002-156839 A 5/2002

* cited by examiner

*Primary Examiner* — William J Royer
(74) *Attorney, Agent, or Firm* — Global IP Counselors, LLP

(57) ABSTRACT

An image forming apparatus includes: an image bearing member that bears an image; and a transfer roller, having a concave portion in its circumferential surface and rotating central to a rotational axis, whose circumferential surface aside from the concave portion makes contact with the image bearing member and transfers the image onto a recording material. The circumferential surface of the transfer roller aside from the concave portion makes contact the image bearing member due to rotation of the transfer roller while the rotational axis of the transfer roller moves away from the image bearing member.

8 Claims, 11 Drawing Sheets

DURING SECONDARY TRANSFER PROCESS

START OF RECORDING PAPER TRANSPORT

START OF PAPER GRIPPING OPERATION

END OF PAPER GRIPPING OPERATION

START OF SECONDARY TRANSFER PROCESS

DURING SECONDARY TRANSFER PROCESS

RELEASE OF RECORDING PAPER

COMPARATIVE EXAMPLE

IMAGE FORMING APPARATUS INCLUDING TRANSFER ROLLER WITH CONCAVE PORTION AND IMAGE FORMING METHOD

BACKGROUND

1. Technical Field

The present invention relates to an image forming apparatus provided with an image bearing member that bears an image and a transfer roller that makes contact with the image bearing member and that has a concave portion in its circumferential surface, and to a method for forming an image using such an image forming apparatus.

2. Related Art

In the field of image forming techniques for forming images upon a recording material such as paper, there are apparatuses configured so as to form a transfer nip by bringing a transfer roller into contact with an image bearing member that temporarily bears an image, and transferring the image onto the recording material by causing the recording material to pass through the transfer nip. For example, with a liquid developer-type image forming apparatus disclosed in JP-A-2002-156830 (for example, see FIG. 1), a backup roller is brought into contact with a drum-shaped intermediate transfer medium at a constant load, and a toner image upon the intermediate transfer medium is pressure-transferred onto paper by causing that paper to pass through a nip thus formed.

When a contact pressure applied to the recording material at the transfer nip increases, so does the likelihood that a problem in which the recording material sticks to the image bearing member will occur. In order to prevent this problem, it is conceivable to provide a concave portion in the transfer roller by partially cutting out the circumferential surface of the transfer roller, and provide a gripping member that grips an end of the recording material within that concave portion. However, if such a measure is taken, the circumferential surface of the transfer roller will no longer have a perfect cylindrical surface, and as a result, the state of contact with the image bearing member will fluctuate in a cyclical manner as the transfer roller rotates. Accordingly, a torque for rotating the transfer roller fluctuates in accordance with the rotation of the transfer roller. Such a fluctuation in the torque causes fluctuations in the speeds of the transfer roller and the image bearing member, which in turn inhibits stable image formation on the image bearing member.

SUMMARY

An advantage of some aspects of the invention is to provide, in an image forming apparatus provided with an image bearing member that bears an image and a transfer roller that makes contact with the image bearing member and that has a concave portion in its circumferential surface, and in a method for forming an image using such an image forming apparatus, a technique for suppressing fluctuations in the speed of the image bearing member and preventing disturbances in images caused by such fluctuations.

An image forming apparatus according to an aspect of the invention includes an image bearing member that bears an image, and a transfer roller, having a concave portion in its circumferential surface and rotating central to a rotational axis, whose circumferential surface aside from the concave portion makes contact with the image bearing member and transfers the image onto a recording material; the circumferential surface of the transfer roller aside from the concave portion makes contact with the image bearing member due to the rotation of the transfer roller while the rotational axis of the transfer roller moves away from the image bearing member.

In addition, an image forming method according to another aspect of the invention includes: causing an image to be borne on an image bearing member; rotating, central to a rotational axis, a transfer roller having a concave portion in its circumferential surface and whose circumferential surface aside from the concave portion makes contact with the image bearing member; and moving the rotational axis of the transfer roller away from the image bearing member when the rotation of the transfer roller causes the concave portion to move from a location in which the concave portion faces the image bearing member and the circumferential surface of the transfer roller aside from the concave potion makes contact with the image bearing member.

In this specification, the phrase "the circumferential surface of the transfer roller makes contact with the image bearing member" refers not only to a case where these two elements come into direct contact with each other, but also to a case where a recording material, which passes through a transfer nip formed by the circumferential surface of the transfer roller and the image bearing member, is present between these two elements, or in other words, a case where the circumferential surface of the transfer roller makes contact with the image bearing member with the recording material therebetween.

In the case where the circumferential surface of the transfer roller that faces the image bearing member is not a uniform cylindrical surface and instead has a concave portion in one part thereof, the torque required to rotate the transfer roller increases suddenly particularly when the surface of the transfer roller that faces the image bearing member changes from the concave portion to the circumferential surface aside from the concave portion, the transfer roller and the image bearing member make contact with each other, and the transfer nip is formed. Such a fluctuation in the torque leads to fluctuations in the speed of the image bearing member, which in turn causes disturbances in the formation of the image on the image bearing member. In response to this, with the aspect of the invention configured as described above, when the transfer roller makes contact with the image bearing member, the transfer roller makes contact with the image bearing member while moving away from the image bearing member. Accordingly, a sudden torque increase occurring when the transfer roller and the image bearing member make contact with each other is softened, and fluctuations in the speed of the image bearing member caused by torque fluctuations are suppressed. It is thus possible to reduce disturbances in the image caused by fluctuations in the speed of the image bearing member.

In the stated image forming apparatus, an adjustment unit that, for example, moves the rotational axis of the transfer roller closer to or away from the image bearing member may be further provided. Doing so makes it possible to maintain an appropriate interval between the rotational axis of the transfer roller and the image bearing member and impart an appropriate contact pressure between the two when the transfer nip is formed, and also makes it possible to soften an increase in the torque when the two come into contact with each other.

More specifically, the adjustment unit may include, for example, a biasing member that biases the transfer roller toward the image bearing member and a holding member that holds the distance between the rotational axis and the image bearing member against the bias exerted by the biasing member. By biasing the transfer roller toward the image bearing member and controlling the interval between the rotational axis thereof and the image bearing member, it is possible both to control the contact pressure at the transfer nip and soften an increase in the torque at the time of contact. Note that the holding member may be a member that functions only when the concave portion of the transfer roller is facing the image bearing member.

As a specific method for causing the transfer roller and the image bearing member to come into contact with each other while moving away from each other, for example, the distance between the rotational axis and the image bearing member when the circumferential surface of the transfer roller aside from the concave portion makes contact with the image bearing member due to the rotation of the transfer roller may be made greater than the distance between the rotational axis and the image bearing member when the concave portion is facing the image bearing member.

In this case, the distance between the rotational axis and the image bearing member when the circumferential surface of the transfer roller aside from the concave portion makes contact with the image bearing member due to the rotation of the transfer roller may be made less than the distance between the rotational axis and the image bearing member when the circumferential surface of the transfer roller aside from the concave portion has made contact with the image bearing member and rotated for a predetermined amount of time. Alternatively, the distance between the rotational axis and the image bearing member may become maximum after the transfer roller and the image bearing member have made contact with each other, and the distance between the rotational axis and the image bearing member may then decrease with the rotation of the transfer roller after the distance between the rotational axis and the image bearing member has become maximum. According to either of these methods, the rotational axis of the transfer roller and the image bearing member move relative to each other so as to move away from each other when the circumferential surface of the transfer roller makes contact with the image bearing member, which makes it possible to soften sudden fluctuations in the torque at the time of the contact.

In addition, an elastic layer, for example, may be provided on the circumferential surface of the transfer roller. In the case where the transfer nip is formed by bringing a transfer roller having an elastic layer on its circumferential surface into contact with the image bearing member, torque for causing the elastic layer to elastically deform is necessary in addition to the torque required to rotate the transfer roller. Accordingly, torque fluctuations increase when the transfer roller and the image bearing member begin to make contact with each other. In the case where a transfer roller configured thus is used, the aspect of the invention can be applied in a particularly favorable manner.

In addition, for example, a gripping portion that grips the recording material onto which the image is transferred may be provided in the concave portion. Providing such a gripping portion makes it possible to prevent, with certainty, the recording material from sticking to the image bearing member at the transfer nip. In this aspect of the invention, because providing the concave portion in the transfer roller prevents fluctuations in the speeds of the transfer roller, the image bearing member, and the like from affecting the image formation, providing the concave portion in the transfer roller and the gripping portion in the concave portion makes it possible to prevent, with certainty, the recording material from sticking to the image bearing member, without affecting the image formation.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
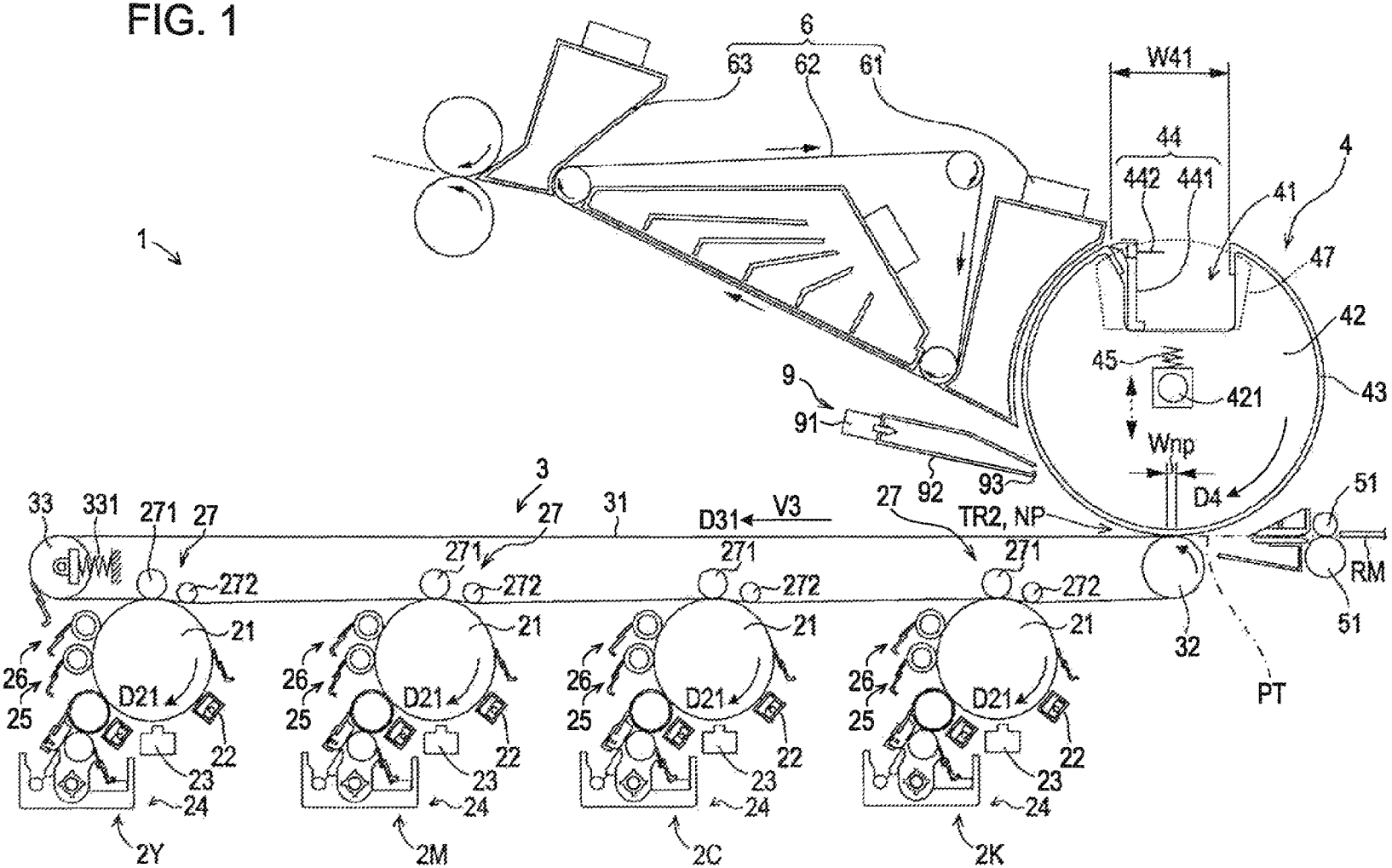
FIG. 1 is a diagram illustrating an embodiment of an image forming apparatus according to the invention.
Figure 2:
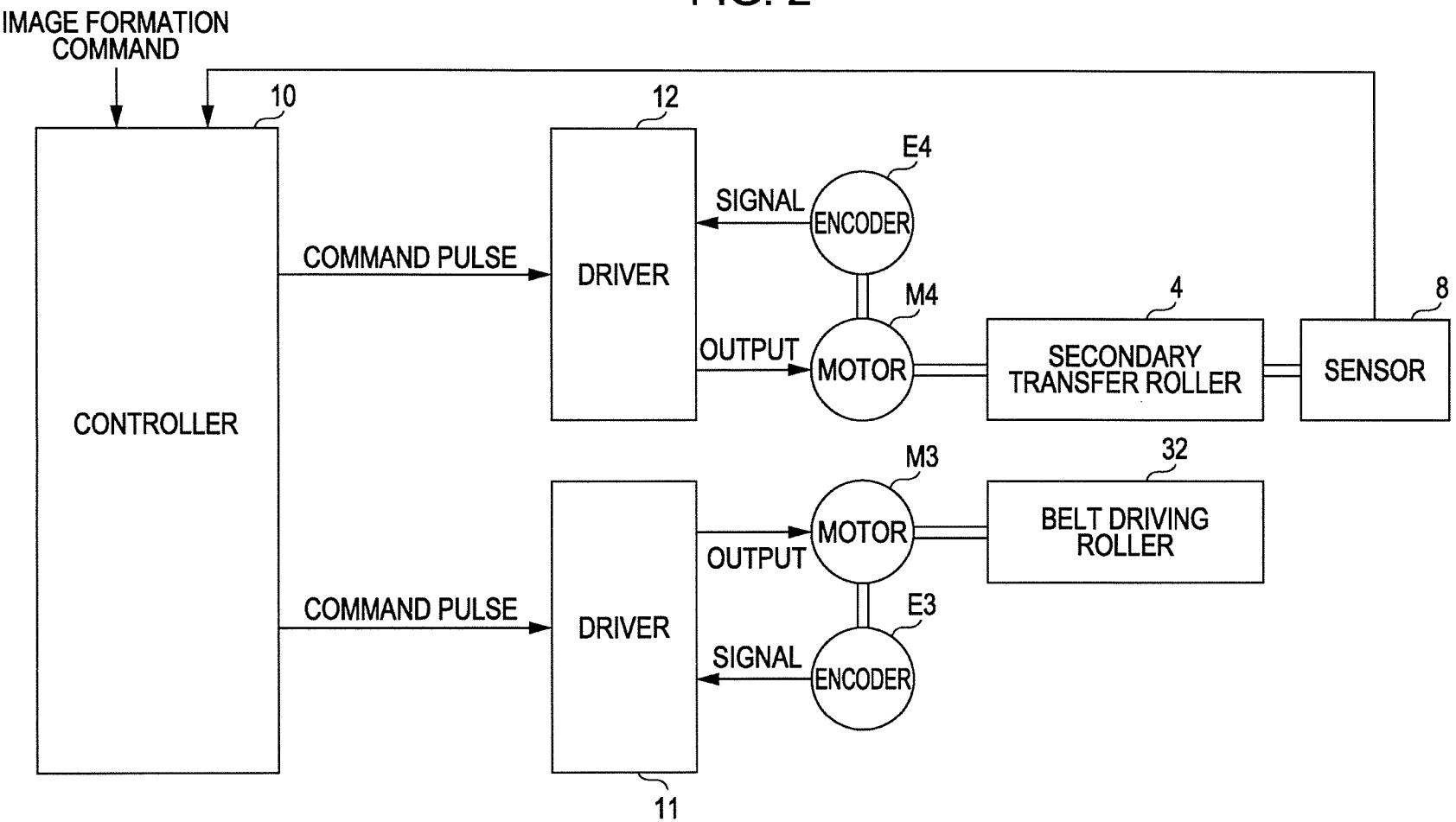
FIG. 2 is a block diagram illustrating an electrical configuration of the image forming apparatus shown in FIG. 1.

FIG. 1 is a diagram illustrating an embodiment of an image forming apparatus according to the invention. FIG. 2, meanwhile, is a block diagram illustrating an electrical configuration of the image forming apparatus illustrated in FIG. 1. An image forming apparatus 1 includes four image forming stations, or 2Y (for yellow), 2M (for magenta), 2C (for cyan), and 2K (for black), that form images of their respective colors. The image forming apparatus 1 is capable of selectively executing a color mode, in which a color image is formed by superimposing yellow (Y), magenta (M), cyan (C), and black (K) toners upon each other, and a monochromatic mode, in which a monochromatic image is formed using only black (K) toner. With this image forming apparatus 1, when an external device such as a host computer or the like provides a controller 10 including a CPU, a memory, and the like with an image formation command, the controller 10 executes predetermined image formation operations by controlling the various elements of the image forming apparatus 1, thus forming an image corresponding to the image formation command upon sheet-shaped recording paper RM, such as copy paper, transfer paper, form paper, transparent OHP sheets, or the like.

Each of the image forming stations 2Y, 2M, 2C, and 2K are provided with a photosensitive drum 21, on the surface of which a toner image of the corresponding color is formed. Each photosensitive drum 21 is disposed so that its rotational axis is parallel or approximately parallel to the main scanning direction (the direction vertical relative to the paper in FIG.

1), and is rotationally driven at a predetermined speed in the direction of the arrow D21 in FIG. 1.

A charging unit 22, which is a corona charging unit that charges the surface of the photosensitive drum 21 to a predetermined potential, an exposure unit 23 that forms an electrostatic latent image by exposing the surface of the photosensitive drum 21 based on an image signal, a developing unit (developing portion) 24 that visualizes the electrostatic latent image as a toner image, a first squeezing unit 25, a second squeezing unit 26, a primary transfer unit 27 that performs a primary transfer of the toner image onto an intermediate transfer belt 31 of a transfer unit 3, a cleaning unit that cleans the surface of the photosensitive drum 21 following the transfer, and a cleaning blade are disposed in the periphery of each photosensitive drum 21, in that order in the rotational direction D21 of the photosensitive drum 21 (in FIG. 1, the clockwise direction).

The charging unit 22 does not make contact with the surface of the photosensitive drum 21, and a known corona charging unit used in the past can be employed as the charging unit 22. In the case where a scorotron charging unit is employed as the corona charging unit, a positive wire current flows through a charge wire of the scorotron charging unit, and a direct-current (DC) grid-charging bias is applied to the grid. The photosensitive drum 21 is charged by the corona discharge emitted by the charging unit 22, and the potential of the surface of the photosensitive drum 21 is set to an approximately uniform potential.

Each exposure unit 23 exposes the surface of its corresponding photosensitive drum 21 using a light beam based on an image signal received from the external device, thus forming an electrostatic latent image corresponding to the image signal. The exposure units 23 can employ a configuration in which a light beam from a semiconductor laser is caused to scan using a polygon mirror, or can be configured of line heads in which light-emitting elements are arranged in the main scanning direction.

The developing units 24 then apply toner to the respective electrostatic latent images formed in this manner, and the electrostatic latent images are developed by the toner as a result. Note that with the developing units 24 of the image forming apparatus 1, the toner development is carried out using a liquid developer in which toner is dispersed within a carrier liquid at a weight ratio of approximately 20%. In this embodiment, a high-concentration and high-viscosity (approximately 30 to 10000 mPa·s) liquid developer having a toner solid content concentration of approximately 20%, and in which solid particles of a colorant such as a pigment having an average particle diameter of 1 μm are dispersed within a resin that is non-volatile at normal temperatures and added to a liquid carrier such as an organic carrier, silicone oil, mineral oil, or cooking oil along with a dispersant, is used, rather than a low-concentration (approximately 1-2 wt %) and low-viscosity volatile liquid developer that uses Isopar (a trademark of Exxon) as its carrier liquid, which is volatile at normal temperatures, as has generally been used in the past.

The first squeezing unit 25 is disposed downstream from a developing position in the rotational direction D21 of the photosensitive drum 21, and the second squeezing unit 26 is furthermore disposed downstream from the first squeezing unit 25. Squeeze rollers are provided in the respective squeezing units 25 and 26. The squeeze rollers make contact with the surface of the photosensitive drum 21 and remove residual carrier liquid and fog toner from the toner image. Although residual carrier liquid, fog toner, and the like are removed by the two squeezing units 25 and 26 in this embodiment, it should be noted that the number and arrangement of squeezing units is not intended to be limited thereto; for example, a single squeezing unit may be provided.

The toner image that has passed through the squeezing units 25 and 26 undergoes a primary transfer onto the intermediate transfer belt 31 by the primary transfer unit 27. The intermediate transfer belt 31 is an endless belt serving as an image bearing member capable of temporarily bearing a toner image on its surface, or to be more specific, on its outer circumferential surface, and is stretched upon multiple rollers 32 and 33. Of these, the roller 32 is mechanically connected to a belt driving motor M3, and functions as a belt driving roller that cyclically drives the intermediate transfer belt 31 in the arrow direction D31 shown in FIG. 1. As shown in FIG. 2, in this embodiment, a driver 11 is provided for driving the belt driving motor M3, and the driver 11 outputs, to the belt driving motor M3, a driving signal based on a command pulse supplied from the controller 10. Through this, the belt driving roller 32 rotates at a rotational speed that corresponds to the command pulse, and the surface of the intermediate transfer belt 31 moves cyclically in the direction D31 at a constant speed V3. Note that the reference numeral E3 in FIG. 2 indicates an encoder that is attached to the belt driving motor M3; the encoder E3 supplies a signal corresponding to the rotation of the belt driving motor M3 to the driver 11, and the driver 11 performs feedback-based control of the belt driving motor M3 based on the received signal.

Although details will be given later, of the rollers 32 and 33 upon which the intermediate transfer belt 31 is stretched, only the aforementioned belt driving roller 32 is driven by the motor M3, and the other roller 33 is a slave roller that does not have a driving source. This slave roller 33 is a tension roller whose rotational shaft is elastically supported by a spring 331 so as to adjust the tension of the intermediate transfer belt 31. To be more specific, the rotational shaft of the tension roller 33 is elastically supported by the spring 331 so as to freely extend/contract in an approximately horizontal direction, and as a result, the tension roller 33 can freely move by a predetermined amount in an approximately horizontal direction in a state in which the intermediate transfer belt 31 is would thereupon. Note that the number of rollers upon which the intermediate transfer belt 31 is stretched is not limited to two; the intermediate transfer belt 31 may be stretched upon three or more rollers, and as described above, in such a case, the rollers aside from the driving roller 32 are slave rollers.

The primary transfer unit 27 includes a backup roller 271 and a winding roller 272. The backup roller 271 is disposed so as to oppose the photosensitive drum 21 with the intermediate transfer belt 31 sandwiched therebetween at a primary transfer location TR1, and makes contact with the photosensitive drum 21 through the intermediate transfer belt 31. Meanwhile, the winding roller 272 is provided downstream in the belt movement direction D31 from that position of contact and pushes the intermediate transfer belt 31 toward the photosensitive drum 21, thus forming a winding portion downstream from the backup roller 271. Furthermore, a primary transfer bias application unit (not shown) is electrically connected to the backup roller 271, and applies a predetermined primary transfer bias, thus transferring the toner image present on the photosensitive drum 21 onto the intermediate transfer belt 31. When the toner images are transferred at the primary transfer units 27 for each of the colors, the toner images of each of the colors upon the photosensitive drums 21 are sequentially superimposed upon the intermediate transfer belt 31, thus forming a full-color toner image.

The toner images transferred onto the intermediate transfer belt 31 in this manner are then transported to a secondary transfer location TR2, as shown in FIG. 1. A secondary transfer roller 4 is provided at this secondary transfer location TR2. This secondary transfer roller 4 is disposed so as to oppose the driving roller 32 of the transfer unit 3 upon which the intermediate transfer belt 31 is wound, with the intermediate transfer belt 31 sandwiched therebetween. A rotational shaft 421 of the secondary transfer roller 4 is elastically supported by a pressure unit 45, which is an elastic member such as a coil spring, and is supported so as to be capable of freely moving toward and away from the intermediate transfer belt 31.

At the secondary transfer location TR2, the single-color or multi-color toner image formed upon the intermediate transfer belt 31 is transferred onto the recording paper RM that is transported along a transport path PT from a pair of gate rollers 51 and 51. Note that in this embodiment, the toner images are formed using a wet-type developing technique that forms the toner images using a liquid developer, and thus the secondary transfer roller 4, which has a gripping portion that will be described in detail later, is used.

The recording paper RM, onto which the toner image has undergone the secondary transfer, is fed into a transport mechanism 6 from the secondary transfer roller 4 along the transport path PT. A first suction unit 61, a recording material transport unit 62, and a second suction unit 63 are arranged in that order in the transport mechanism 6 along the transport path PT, and these units function in cooperation with each other to transport the recording paper RM to a fixing unit 7.

Meanwhile, when the recording paper RM, onto which the toner image has undergone the secondary transfer, is fed into the aforementioned transport mechanism 6, a blowing unit 9 is, in this embodiment, disposed opposite to the secondary transfer roller 4 and between the secondary transfer location TR2 and the first suction unit 61 in order to feed the recording paper RM to the first suction unit 61 with certainty and prevent the image thereon from being soiled. With this blowing unit 9, airflow generated through the operation of an airflow generation unit 91 is expelled from an opening portion 93 of a housing portion 92 as indicated by the white arrow; as a result, the air is blown against the leading edge of the recording paper RM, which has been released from the grip of the secondary transfer roller 4 (a gripping portion 44, described later), and that leading edge is pushed in a direction away from the secondary transfer roller 4 by a protruding claw (not shown). In this manner, the leading edge of the recording paper RM is fed toward the first suction unit 61. In addition, the blowing of air onto the recording paper RM makes it possible to prevent the following edge of the recording paper RM from making contact with the intermediate transfer belt 31 or the like and the image thereon being soiled when the following edge is discharged from the secondary transfer location TR2. Note that the air blowing performed by the blowing unit 9 may be omitted in the case where the recording paper RM has a low elastic restitution force and is flimsy.

Furthermore, the fixing unit 7 is disposed downstream in the transport path PT, or in other words, is disposed on the side of the transport mechanism 6 that is opposite to the secondary transfer roller 4 (that is, the left-hand side in FIG. 1), and the single-color or multi-color toner image that has been transferred onto the recording paper RM is fixed onto the recording paper RM by applying heat, pressure, or the like to that toner image.

Figure 3:
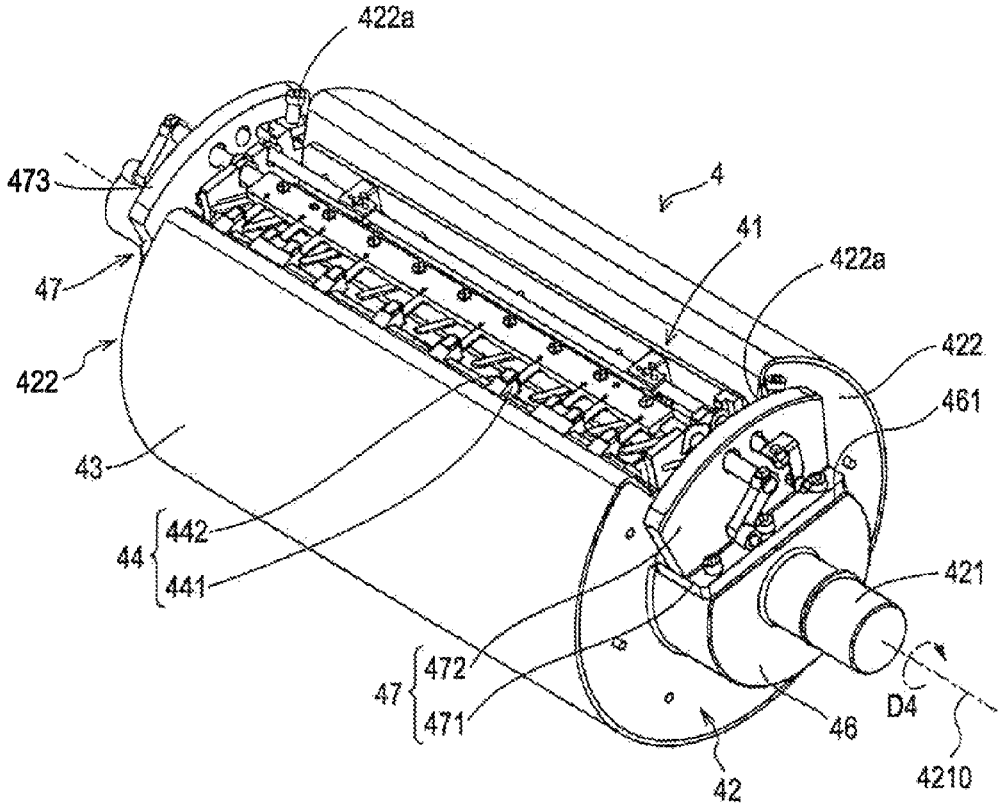
FIG. 3 is a perspective view illustrating the overall configuration of a secondary transfer roller.

FIG. 3 is a perspective view illustrating the overall configuration of the secondary transfer roller 4. As shown in FIGS. 1 and 3, the secondary transfer roller 4 has a roller base member 42 in which a concave portion 41, formed by cutting out part of the outer circumferential surface of the roller cylinder, is provided. With this roller base member 42, a rotational shaft 421 that freely rotates in a direction D4 central to a rotational axis 4210 is disposed so as to be parallel or approximately parallel to the rotational axis of the driving roller 32, and the roller base member 42 is biased toward the driving roller 32 by the pressure unit 45 and is thus given a predetermined load (in this embodiment, 60 kgf). Meanwhile, side plates 422 and 422 are respectively attached to the ends of the rotational shaft 421. To be more specific, the side plates 422 and 422 each have a shape in which a cutout portion 422*a* in provided in a disk-shaped metallic plate. As shown in FIG. 3, the cutout portions 422*a* and 422*a* are provided on the rotational shaft 421 a distance that is slightly longer than the width of the intermediate transfer belt 31, and are provided opposite to each other. Accordingly, the roller base member 42 is formed so as to have an overall drum shape, but to also have the concave portion 41 extending parallel or approximately parallel to the rotational shaft 421 in a portion of its outer circumferential surface.

Meanwhile, an elastic layer 43, configured of rubber, a resin, or the like, is formed upon the outer circumferential surface of the roller base member 42, or in other words, on the surface region of the metallic plate excluding the region corresponding to the inner area of the concave portion 41. The elastic layer 43 opposes the intermediate transfer belt 31 that is wound upon the driving roller 32, thus forming a transfer nip NP.

In addition, a gripping portion 44 for gripping the recording paper RM is disposed within the concave portion 41. This gripping portion 44 includes gripper support members 441 erected from the inner base area of the concave portion 41 toward the outer circumferential surface of the roller base member 42 and gripper members 442 supported so as to be freely making contact with/separating from the tip areas of corresponding gripper support members 441. Each of the gripper members 442 is connected to a gripper driving unit (not shown). Upon receiving a release command from the controller 10, the gripper driving unit operates so that the tip areas of the gripper members 442 separate from the tip areas of the gripper support members 441, thus preparing to grip the recording paper RM, releasing a caught recording paper RM, and the like. On the other hand, upon receiving a grip command from the controller 10, the gripper driving unit operates so that the tip areas of the gripper members 442 move to the tip areas of the gripper support members 441, thus gripping the recording paper RM. Note that the configuration of the gripping portion 44 is not limited to that described in this embodiment, and another gripping mechanism known from the past may be employed instead.

A support member 46 is attached to the outside surface of each of the side plates 422 at both ends of the secondary transfer roller 4, and each is capable of rotating integrally with the roller base member 42. Furthermore, planar regions 461 are formed on the support members 46 in correspondence with the concave portion 41. Transfer roller-side contact members 47 are attached to the respective planar regions 461. In each contact member 47, a base section 471 is attached to the support member 46, and a contact section 472 extends from the base section 471 in the normal line direction of the planar region 461; the tip area of the contact section 472 extends to the vicinity of the side end of the opening of the concave portion 41. In other words, if the roller base member 42 is viewed from the end of the rotational shaft 421, the contact members 47 are disposed so as to cover the concave portion 41.

Meanwhile, as will be described later, a bearing 322 (see FIG. 7B) that has a greater outer diameter than the diameter of the driving roller 32 and that is capable of rotating independently from the driving roller 32 about the same axis as the driving roller 32 is provided on the end portion of the driving roller 32, upon which the intermediate transfer belt 31 is wound. When the contact member 47 of the secondary transfer roller 4 is facing toward the driving roller 32, the outer circumferential surface of the contact member 47 and the outer circumferential surface of the bearing 322 make contact with each other, thus regulating the interval between the rotational axis 4210 of the secondary transfer roller 4 and the surface of the intermediate transfer belt 31, against the biasing force of the pressure unit 45.

Note that in this embodiment, the length of the opening (opening width) W41 of the concave portion 41 along the rotational direction D4 of the roller base member 42 is approximately 105 mm. When the elastic layer 43 formed upon the regions of the outer circumferential surface of the secondary transfer roller 4 aside from the concave portion 41 is facing the intermediate transfer belt 31, the elastic layer 43 is pressed against the intermediate transfer belt 31, thus forming the transfer nip NP. The length of the transfer nip NP in the rotational direction D4 of the roller base member 42 (the transfer nip width) Wnp is approximately 11 mm, and thus the following relationship is established: (opening width W41 of concave portion 41)>(transfer nip width Wnp of transfer nip NP) Accordingly, the transfer nip temporarily disappears when the concave portion 41 of the secondary transfer roller 4 opposes the intermediate transfer belt 31.

Meanwhile, the length of the elastic layer 43 along the rotational direction D4 of the roller base member 42 is set to approximately 495 mm, which is in order to enable the largest size recording paper RM that can be used in the image forming apparatus 1 to be wound thereupon. In other words, the length of the elastic layer 43 is set to be longer than the length of the usable recording paper whose length along the rotational direction D4 of the roller base member 42 is the maximum length.

A transfer roller driving motor M4 is mechanically connected to the rotational shaft 421 of the secondary transfer roller 4. In this embodiment, a driver 12 for driving the transfer roller driving motor M4 is also provided, as shown in FIG. 2. The driver 12 drives the motor M4 based on commands supplied by the controller 10, thus rotationally driving the secondary transfer roller 4 in the direction D4, which is the clockwise direction in FIG. 1, or in other words, in the same direction relative to the belt movement direction D31.

In this embodiment, the driver 12 outputs, to the motor M4, a driving signal that is based on a command pulse supplied by the controller 10. Through this, the secondary transfer roller 4 rotates at a rotational speed corresponding to the command pulse.

Note that the reference numeral E4 in FIG. 2 indicates an encoder attached to the transfer roller driving motor M4; the encoder E4 supplies a signal corresponding to the rotation of the transfer roller driving motor M4 to the driver 12, and the driver 12 performs feedback-based control of the motor M4 based on the received signal. Meanwhile, the reference numeral 8 indicates a phase detection sensor linked to one end of the rotational shaft 421 of the secondary transfer roller 4, and the controller 10 is capable of grasping the timing at which the recording paper RM passes through the transfer nip NP based on the output of this phase detection sensor 8.

FIGS. 4A through 4D, 5A, and 5B are diagrams schematically illustrating operations performed by the image forming apparatus 1 illustrated in FIG. 1. Operations performed by the image forming apparatus 1 configured as described thus far will be described with reference to FIGS. 4A through 4D, 5A and B. With the image forming apparatus 1, when an image formation command prompting the formation of a color image has been supplied by the external device such as a host computer or the like to the controller 10, the controller 10 controls the various elements of the image forming apparatus 1 in accordance with programs stored in a memory (not shown). First, the belt driving motor M3 and the transfer roller driving motor M4 operate, thus driving the intermediate transfer belt 31 and the secondary transfer roller 4, respectively.

Then, the phase detection sensor 8 (FIG. 2) provided in the secondary transfer roller 4 temporarily outputs an H level signal when the surface of the secondary transfer roller 4 opposing the intermediate transfer belt 31 at the secondary transfer location TR2 changes from the cylindrical circumferential surface on which the elastic layer 43 is provided to the concave portion 41, and when the concave portion 41 changes to the elastic layer 43. In other words, with the phase detection sensor 8, a disk-shaped slit plate 81 is connected to the rotational shaft 421 of the secondary transfer roller 4 and rotates along with the rotational shaft 421, as shown in FIGS. 4A through 4D, 5A and B. Slits 811 and 812 are formed in two locations in the slit plate 81. Whereas the slit 811 is used for detecting a nip ending position, or in other words, the position at which the elastic layer 43 separates from the intermediate transfer belt 31, the slit 812 is used for detecting a nip starting position, or in other words, the position at which the elastic layer 43 begins to make contact with the intermediate transfer belt 31, thus forming the transfer nip NP. Furthermore, with the phase detection sensor 8, a sensor element 82 for detecting the slits 811 and 812 is disposed in a fixed manner) each time the slits 811 and 812 are within the detection range of the sensor element 82, the level of a signal outputted from the sensor element 82 to the controller 10 changes from L level to H level, thus making it possible to detect the nip ending position and the nip starting position, respectively. Accordingly, the recording paper RM is detected as passing into the transfer nip NP when the slit 812 is positioned within the detection range of the sensor element 82.

When the output of the phase detection sensor 8 changes at a predetermined timing, and the secondary transfer roller 4 changes from the concave portion 41 to the elastic layer 43 at the secondary transfer location TR2 and the transfer nip NP is formed, that timing is used as an exposure starting point; toner images are formed at the image forming stations 2Y, 2M, 2C, and 2K, and the toner images then undergo the primary transfer onto the surface of the intermediate transfer belt 31. In other words, when a predetermined amount of time has elapsed following the aforementioned timing, the exposure unit 23 commences latent image formation in the image forming station 2Y based on various signals from the controller 10, thus forming a toner image from yellow toner. An exposure for magenta is commenced after the exposure for yellow has been commenced, an exposure for cyan is commenced after the exposure for magenta has been commenced, and an exposure for black is commenced after the exposure for cyan has been commenced. Accordingly, toner images of each of the colors are formed and superimposed in order upon the intermediate transfer belt 31, thus forming a full-color toner image TI upon the surface of the intermediate transfer belt 31.

Figure 4A:
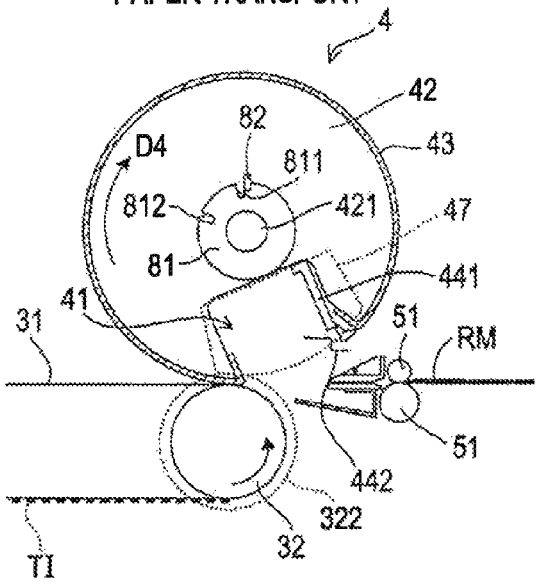
FIGS. 4A through 4D are the first four of six diagrams schematically illustrating operations performed by the image forming apparatus illustrated in FIG. 1.

While the toner images of each of the colors are being formed in this manner, the secondary transfer roller 4 rotates further in the rotational direction D4, and the transfer nip NP that disappeared is formed once again. When a predetermined amount of time has elapsed following this timing, the controller 10 inputs a command pulse to a driver (not shown) that controls a gate roller driving motor (also not shown) connected to the gate rollers 51, thus causing the gate roller driving motor to operate. As a result, transport of the recording paper RM to the secondary transfer location TR2 commences (FIG. 4A).

Figure 4B:
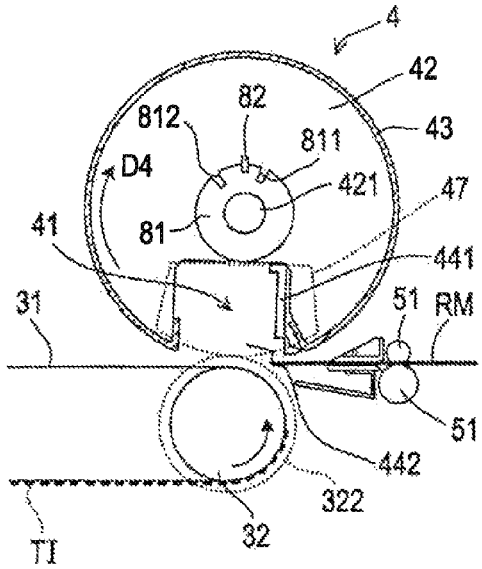

Meanwhile, when the secondary transfer roller 4 changes to the concave portion 41 at the secondary transfer location TR2 and the transfer nip disappears, the slit 811 is positioned within the detection range of the sensor element 82, and thus the level of the signal outputted by the sensor element 82 to the controller 10 changes from the L level to the H level. Based on this signal, the controller 10 supplies s command pulse to the driver 12. As a result, the secondary transfer roller 4 rotates in the rotational direction D4, moving to a predetermined recording paper gripping position (FIG. 4B). Meanwhile, the tip areas of the gripper members 442 are caused to separate from the tip areas of the gripper support members 441, thus completing preparations for gripping the recording paper RM. The leading edge of the recording paper RM fed from the gate rollers 51 enters between the gripper members 442 and the gripper support members 441, thus commencing a paper gripping operation.

Figure 4C:
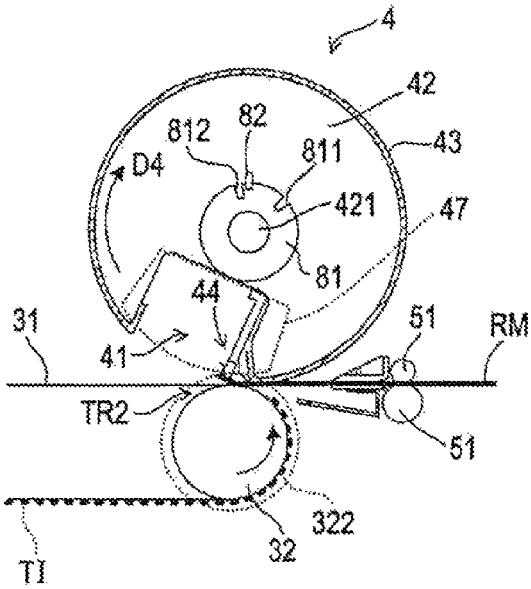

The controller 10 then supplies a catch command to the gripper driving unit (not shown). The gripper driving unit operates based on this catch command, causing the tip areas of the gripper members 442 to move to the tip areas of the gripper support members 441. As a result, the leading edge of the recording paper RM is caught, thus completing the paper gripping operation (FIG. 4C). Note that at the point in time when the paper gripping operation is completed, the toner image TI is located upstream from the secondary transfer location TR2 in the movement direction D31 of the surface of the intermediate transfer belt 31, as shown in FIG. 4C.

Figure 4D:
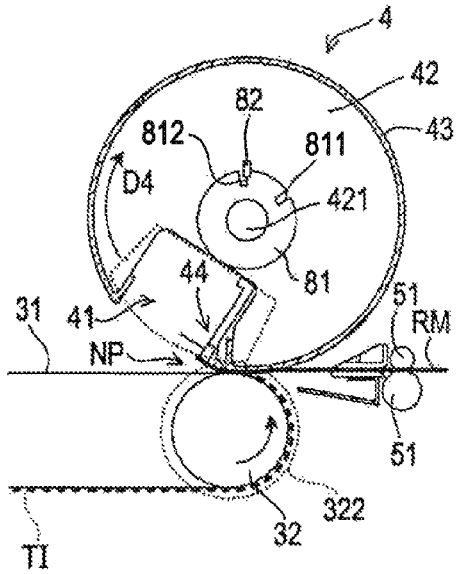

In this manner, the recording paper RM is transported in the rotational direction D4 along with the secondary transfer roller 4 with its leading edge caught by the gripping portion 44. Then, at the timing at which the elastic layer 43 on the surface of the secondary transfer roller 4 reaches the secondary transfer location TR2 and the formation of the transfer nip NP starts, the slit 812 is located within the detection range of the sensor element 82, as shown in FIG. 4D; thus the level of the signal outputted to the controller 10 by the sensor element 82 changes from the L level to the H level.

The recording paper RM is pinched in the transfer nip NP formed by the secondary transfer roller 4 and the intermediate transfer belt 31 and is transported through the rotation of the secondary transfer roller 4. As a result, the secondary transfer of the toner image TI formed on the intermediate transfer belt 31 onto the lower surface (the image surface) of the recording paper RM is commenced (FIG. 4D). Meanwhile, at this timing, the controller 10 switches the driving control system of the driver 12 to torque-control using a control switching signal, and performs torque-controlling of the secondary transfer roller 4 by supplying a specified torque command to the driver 12.

Figure 5A:
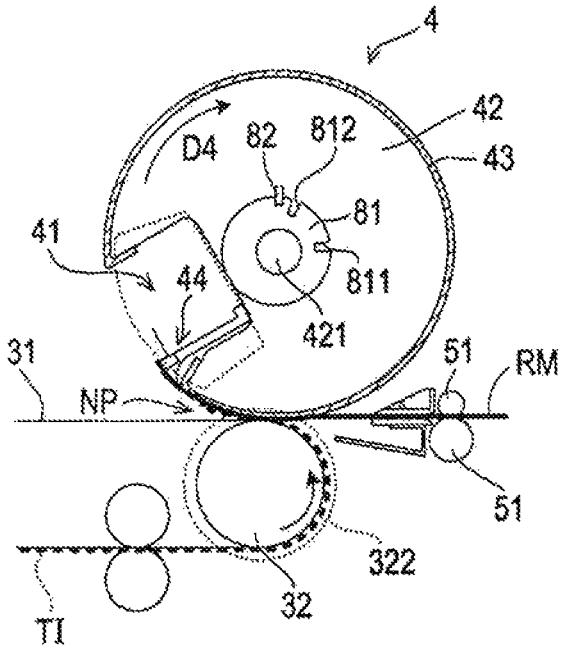
FIGS. 5A through 5B are the last two of six diagrams schematically illustrating operations performed by the image forming apparatus illustrated in FIG. 1.
Figure 5B:
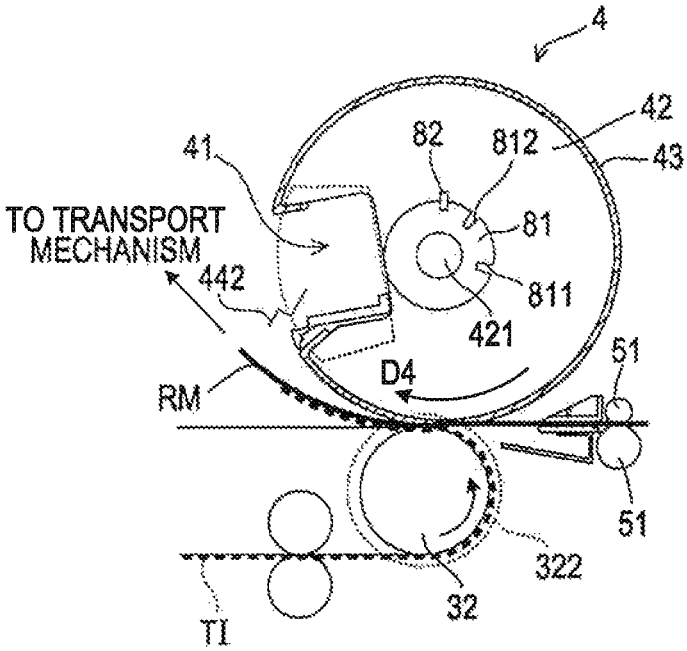

The secondary transfer roller 4 rotates in the rotational direction D4 while undergoing the torque-control in this manner; as a result, the recording paper RM passes through the transfer nip NP with its leading edge held by the gripping portion 44, and the secondary transfer of the toner image TI progresses further (FIG. 5A). Then, when the gripping portion 44 moves to a position in the vicinity of the transport mechanism 6, the leading edge of the recording paper that is held by the gripping portion 44 separates from the intermediate transfer belt 31 to a sufficient degree, and is transported to a transport entrance of the transport mechanism 6. As shown in FIG. 5B, the controller 10 supplies a release command to the gripper driving unit when the gripping portion 44 has moved to the vicinity of the upstream end of the transport mechanism 6, causing the tip areas of the gripper members 442 to separate from the tip areas of the gripper support members 441, thus releasing the recording paper RM. Through this, the leading edge of the recording paper RM is fed to the transport mechanism 6 with certainty, without sticking to the surface of the intermediate transfer belt 31. The color toner image TI is then fixed to the recording paper RM by the fixing unit 7, which is disposed after the transport mechanism 6. Note that following the release, the leading side of the recording paper RM is transported toward the fixing unit 7 along the transport path PT, whereas the following side of the recording paper RM undergoes the secondary transfer process while being pinched and transported at the transfer nip NP by the elastic layer 43 of the secondary transfer roller 4 and the intermediate transfer belt 31.

With the image forming apparatus 1 that executes the operations described thus far, the secondary transfer roller 4 has a cutout shape in part of its circumferential surface, and thus the transfer nip NP is formed and temporarily disappears in a cyclical manner as the secondary transfer roller 4 rotates. To be more specific, when the elastic layer 43 on the circumferential surface of the secondary transfer roller 4 is facing the driving roller 32, the elastic layer 43 and the intermediate transfer belt 31 come into contact with each other, thus forming the transfer nip NP; however, when the concave portion 41 is facing the driving roller 32, the secondary transfer roller 4 and the intermediate transfer belt 31 separate from each other, and the transfer nip NP disappears as a result.

Accordingly, from the standpoint of the transfer roller driving motor M4 that rotationally drives the secondary transfer roller 4, the torque fluctuates in a cyclical manner as the secondary transfer roller 4 rotates. To be more specific, when the transfer nip NP is formed, the elastic layer 43 of the secondary transfer roller 4 makes contact with the intermediate transfer belt 31 wound upon the driving roller 32, thus creating a load; as a result, from the standpoint of the transfer roller driving motor M4, the torque is comparatively high. On the other hand, when the concave portion 41 is facing the driving roller 32 and the transfer nip NP has disappeared, the circumferential surface of the contact member 47 in the secondary transfer roller 4 only makes contact with the bearings 322, which are provided in the driving roller 32 in a freely rotating state; thus from the standpoint of the transfer roller driving motor M4, the torque is extremely low.

When the torque fluctuates significantly in such a manner depending on the rotational angle of the secondary transfer roller 4, it is easy for the rotational speed of the secondary transfer roller 4 that is rotationally driven by the transfer roller driving motor M4 to become unstable. For example, when the surface of the secondary transfer roller 4 that opposes the driving roller 32 switches from the concave portion 41 to the elastic layer 43, or in other words, when the state switches from that shown in FIG. 4C to that shown in FIG. 4D, the torque of the transfer roller driving motor M4 increases suddenly, and the rotational speed of the secondary transfer roller 4 undergoes a significant transitional drop as a result. The fluctuation in the rotational speed of the secondary transfer roller 4 causes a fluctuation in the speed of the intermediate transfer belt 31 that makes contact therewith, which in turn causes disturbances in the image formation that occurs at the primary transfer location TR1.

Accordingly, in this embodiment, sudden fluctuations in the torque of the secondary transfer roller 4 from the standpoint of the transfer roller driving motor M4 are suppressed by devising the outer circumferential shape of the contact member 47.

Figure 6:
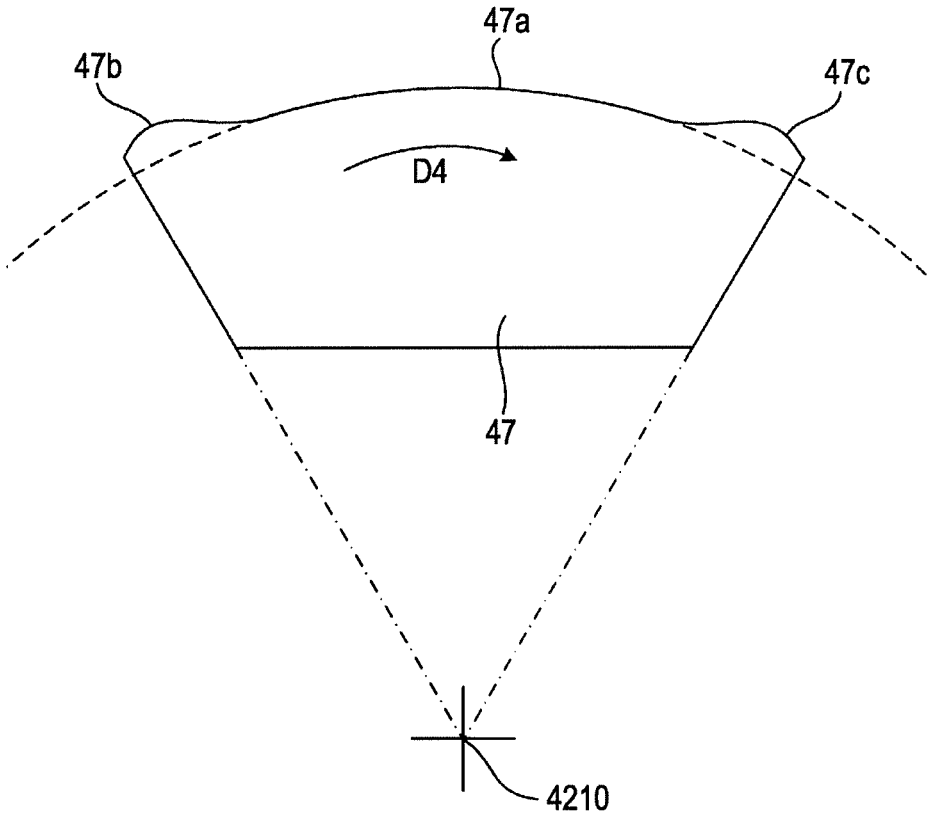
FIG. 6 is a diagram illustrating the shape of the outer circumferential surface of a contact member according to the embodiment.

FIG. 6 is a diagram illustrating the shape of the outer circumferential surface of the contact member 47 according to this embodiment. To simply maintain a constant interval between the rotational axis 4210 of the secondary transfer roller 4 and the intermediate transfer belt 31 when the concave portion 41 is facing the driving roller 32, the outer circumferential surface of the contact member 47 may be made so as to form an arc that is central to the rotational axis 4210 of the secondary transfer roller 4, as illustrated by the broken line in FIG. 6. However, in this embodiment, while an outer circumferential surface central portion 47*a* of the contact member 47 is made so as to form an arc shape that is central to the rotational axis 4210 of the secondary transfer roller 4, protruding sections 47*b* and 47*c*, which bulge outward from that arc, are provided in the vicinity of the ends of that arc. Note that the amount by which the protruding sections 47*b* and 47*c* protrude in the radial direction has been exaggerated in FIG. 6 in order to facilitate understanding. The reason for employing such a shape will be described hereinafter.

Figure 7A:
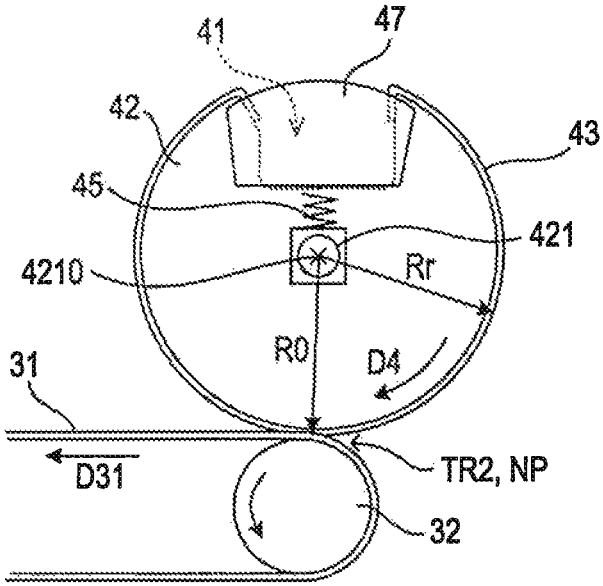
FIGS. 7A and 7B are the first two of three diagrams illustrating intervals between the rotational axis of the secondary transfer roller and an intermediate transfer belt.

FIGS. 7A, B and 8 are diagrams illustrating intervals between the rotational axis 4210 of the secondary transfer roller 4 and the intermediate transfer belt 31. In this embodiment, the rotational axis 4210 of the secondary transfer roller 4 is supported by the pressure unit 45 so as to be capable of separating from and making contact with the intermediate transfer belt 31; as a result, the interval between the rotational axis 4210 of the secondary transfer roller 4 and the intermediate transfer belt 31 is not constant, and instead fluctuates in a cyclical manner as the secondary transfer roller 4 rotates. First, when the elastic layer 43 of the secondary transfer roller 4 presses upon the intermediate transfer belt 31 and the transfer nip NP is formed, as shown in FIG. 7A, an interval R0 between the rotational axis 4210 of the secondary transfer roller 4 and the intermediate transfer belt 31 takes on a value that is slightly less than the original radius of the secondary transfer roller 4, or in other words, slightly less than an interval Rr between the rotational axis 4210 and the surface of the elastic layer 43 which is not making contact with the intermediate transfer belt 31. This is because at the transfer nip NP, the elastic layer 43 is pressed by an amount equivalent to the force of the pressure, and the thickness of the elastic layer 43 decreases as a result.

Figure 7B:
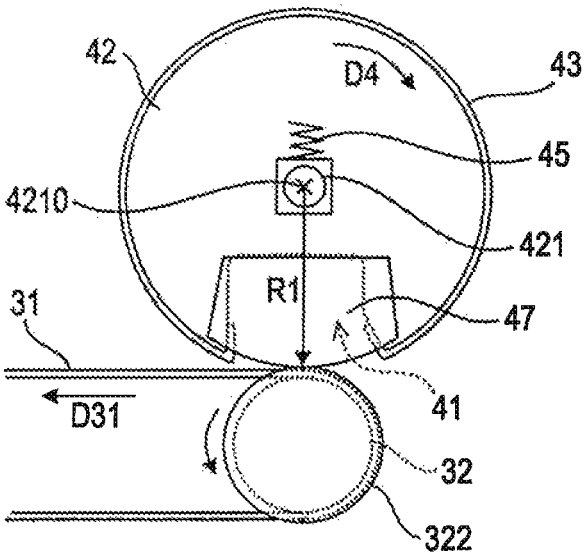

On the other hand, when the concave portion 41 is facing the driving roller 32 and the transfer nip NP has disappeared, as shown in FIG. 7B, the respective outer circumferential surfaces of the contact member 47 attached to the secondary transfer roller 4 and the bearing 322 attached to the driving roller 32 make contact with each other, and as a result, an interval R1 arises between the rotational axis 4210 of the secondary transfer roller 4 and the intermediate transfer belt 31. The interval R1 at this time is defined by the shapes of the contact member 47 and the bearing 322. Here, because the bearing 322 has a disc shape, the interval R1 between the rotational axis 4210 of the secondary transfer roller 4 and the intermediate transfer belt 31 is in essence defined by the outer circumferential shape of the contact member 47.

Figure 8:
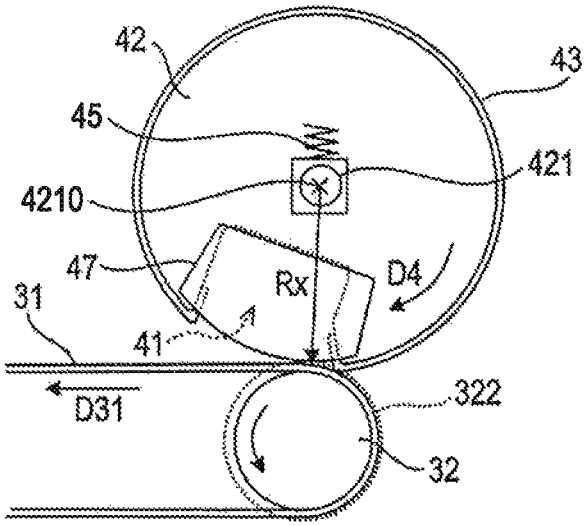
FIG. 8 is the last of three diagrams illustrating intervals between the rotational axis of the secondary transfer roller and the intermediate transfer belt.

The outer circumferential shape of the contact member 47 is set so as to reduce the torque fluctuation occurring when the state switches from one in which the concave portion 41 is facing the driving roller 32, as shown in FIG. 7B, to one in which the elastic layer 43 makes contact with the intermediate transfer belt 31, as shown in FIG. 8. As shown in FIG. 8, the interval between the rotational axis 4210 of the secondary transfer roller 4 and the intermediate transfer belt 31 when the elastic layer 43 begins to make contact with the intermediate transfer belt 31 is indicated by the reference symbol Rx.

Figure 9:
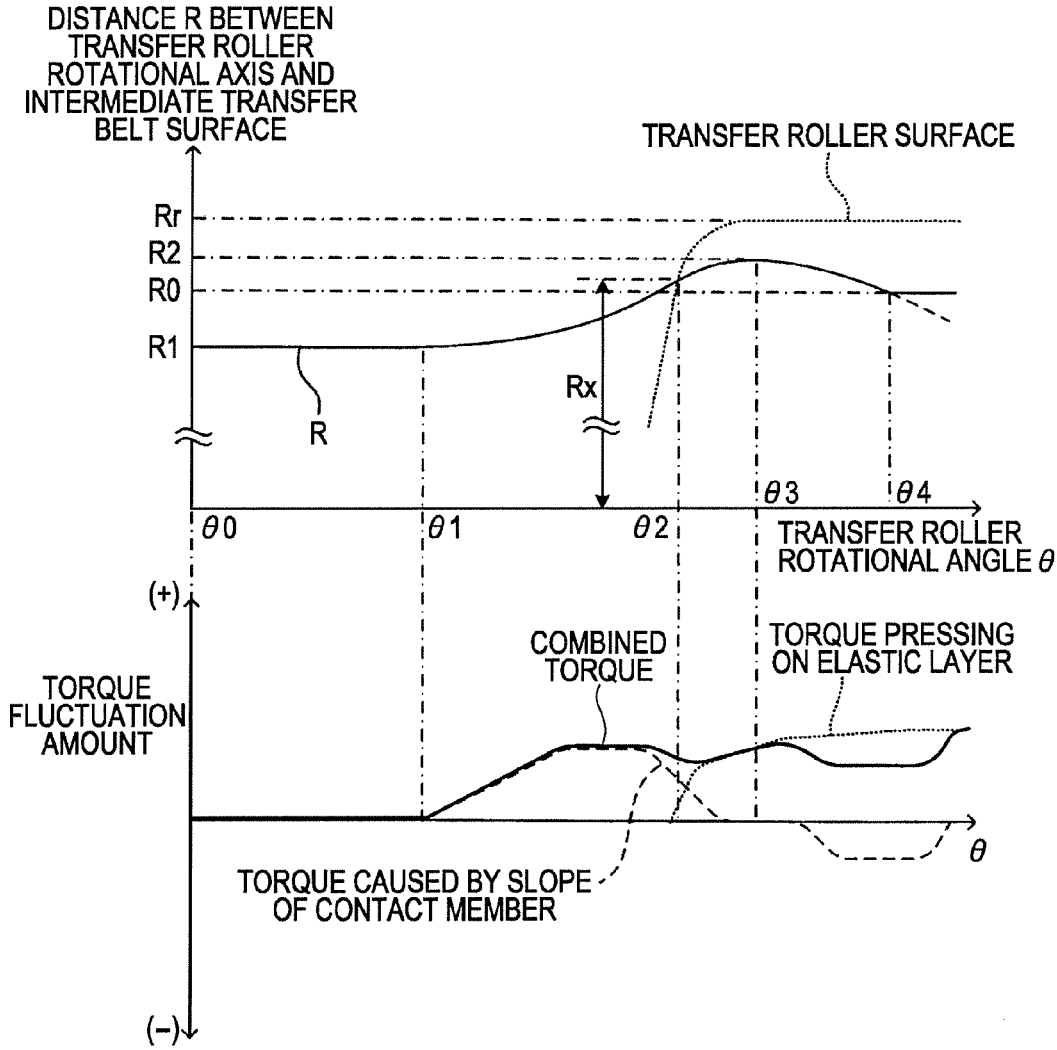
FIG. 9 is a diagram illustrating the state of change in an interval between the rotational axis of the secondary transfer roller and the intermediate transfer belt.

FIG. 9 is a diagram illustrating the state of change in the interval between the rotational axis 4210 of the secondary transfer roller 4 and the intermediate transfer belt 31. More specifically, FIG. 9 is a diagram in which the state of change in the interval R between the rotational axis 4210 of the secondary transfer roller 4 and the intermediate transfer belt 31 in this embodiment and the state of fluctuation in the torque from the standpoint of the transfer roller driving motor M4 are shown in association with a rotational angle θ of the secondary transfer roller 4. Here, as shown in FIG. 7B, the position (angle) of the secondary transfer roller 4 when the central portion of the concave portion 41 in the rotational direction D4 of the secondary transfer roller 4 is facing the driving roller 32 is defined as an origin θ0 of the rotational angle θ; however, in principle, any position may be used as the origin. Meanwhile, with respect to the torque of the transfer roller driving motor M4, the amounts of increase/decrease are expressed using the torque occurring when the secondary transfer roller 4 is rotationally driven by itself as a reference.

In this embodiment, the length from the secondary transfer roller rotational axis 4210 to the central portion 47*a* of the contact member 47 (see FIG. 6) and the outer diameter of the bearing 322 are set so that the interval R1 between the rotational axis 4210 of the secondary transfer roller 4 and the intermediate transfer belt 31 when the concave portion 41 is facing the driving roller 32 has a lower value than the interval R0 when the transfer nip NP is formed. In other words, the rotational axis 4210 of the secondary transfer roller 4 at this time is closer to the intermediate transfer belt 31 than when the transfer nip NP is formed.

On the other hand, as shown in FIG. 6, the outer circumferential surface of the contact member 47 protrudes at the end portions thereof so that the radius increases towards the end portions. From the angle at which the protruding section 47*b*, which is located upstream from the central portion 47*a* in the rotational direction D4 of the secondary transfer roller 4, reaches its point of contact with the bearing 322 (θ=θ1), the interval between the rotational axis 4210 of the secondary transfer roller 4 and the intermediate transfer belt 31 increases gradually with the increase in the radius of the contact member 47. At this time, the slope of the surface of the contact member 47 whose radius being increased acts as a load, and from the standpoint of the transfer roller driving motor M4, the torque (indicated by the broken line) increases little by little.

In FIG. 9, the profile of the surface of the secondary transfer roller 4, or to be more specific, the profile of the surface of the elastic layer 43 that is not being pressed by the intermediate transfer belt 31, is indicated by the dotted line. At the angle at which the curve expressing the interval R between the rotational axis 4210 of the secondary transfer roller 4 and the intermediate transfer belt 31, which is indicated by a solid line in FIG. 9, intersects with the profile curve of the surface of the secondary transfer roller 4 (θ=θ2), the elastic layer 43 on the surface of the secondary transfer roller 4 has started to make contact with the intermediate transfer belt 31 (a state that is illustrated in FIG. 8). At this time, the curve expressing the interval R has a positive slope, indicating that the elastic layer 43 and the intermediate transfer belt 31 have started. to come into contact with each other while the rotational. axis 4210 of the secondary transfer roller 4 and the intermediate transfer belt 31 are moving away from each other. The interval Rx between the rotational axis 4210 of the secondary transfer roller 4 and the intermediate transfer belt 31 is greater than the interval R1 found when the concave portion 41 is facing the driving roller 32, and furthermore, the interval at this time continues to increase.

When the elastic layer 43 of the secondary transfer roller 4 and the intermediate transfer belt 31 begin to come into contact with each other, the torque required to press the elastic layer 43 (indicated by a dotted line) is exerted on the transfer roller driving motor M4. However, at this stage, the interval between the rotational axis 4210 of the secondary transfer roller 4 and the intermediate transfer belt 31 is still defined by the contact member 47, and that interval is furthermore increasing; therefore, the amount by which the elastic layer 43 is pressed only increases little by little, and thus the increase in the torque is also gradual. Then, at the angle θ=θ3, at which the surface of the contact member 47 is the farthest from the rotational axis 4210, the interval between the rotational axis 4210 of the secondary transfer roller 4 and the intermediate transfer belt 31 is a maximum value R2, At this time, the increase in the torque caused by the slope of the surface of the contact member 47 stops.

After this, the interval between the rotational axis 4210 of the secondary transfer roller 4 and the intermediate transfer belt 31 gradually decreases as the surface of the contact member 47 retracts, whereas the amount by which the elastic layer 43 is pressed increases. At this time, although the torque caused by the slope of the surface of the contact member 47 gradually decreases, the torque required to press the elastic layer 43 increases little by little in correspondence with the increase in the amount of pressure. The amount of the increase in the torque can be controlled by the surface shape of the end portion of the contact member 47, and thus the amount of the increase in the torque can be made slight by making that surface shape into a smooth shape in which the distance from the rotational axis 4210 decreases little by little.

The transfer nip NP is ultimately completed when the elastic layer 43 is pressed by the maximum amount. In this state, the interval R0 between the rotational axis 4210 of the secondary transfer roller 4 and the intermediate transfer belt 31 is determined by the hardness of the elastic layer 43, and is unrelated to the contact member 47. In addition, the torque of the transfer roller driving motor M4 is mainly only the torque required to press the elastic layer 43. Ultimately, in this embodiment, the combined torque, in which the torque caused by the slope of the contact member 47 and the torque required to press the elastic layer 43 are taken together, increases slightly from when the radius of the contact member 47 begins to increase to when the transfer nip NP is formed.

Figure 10:
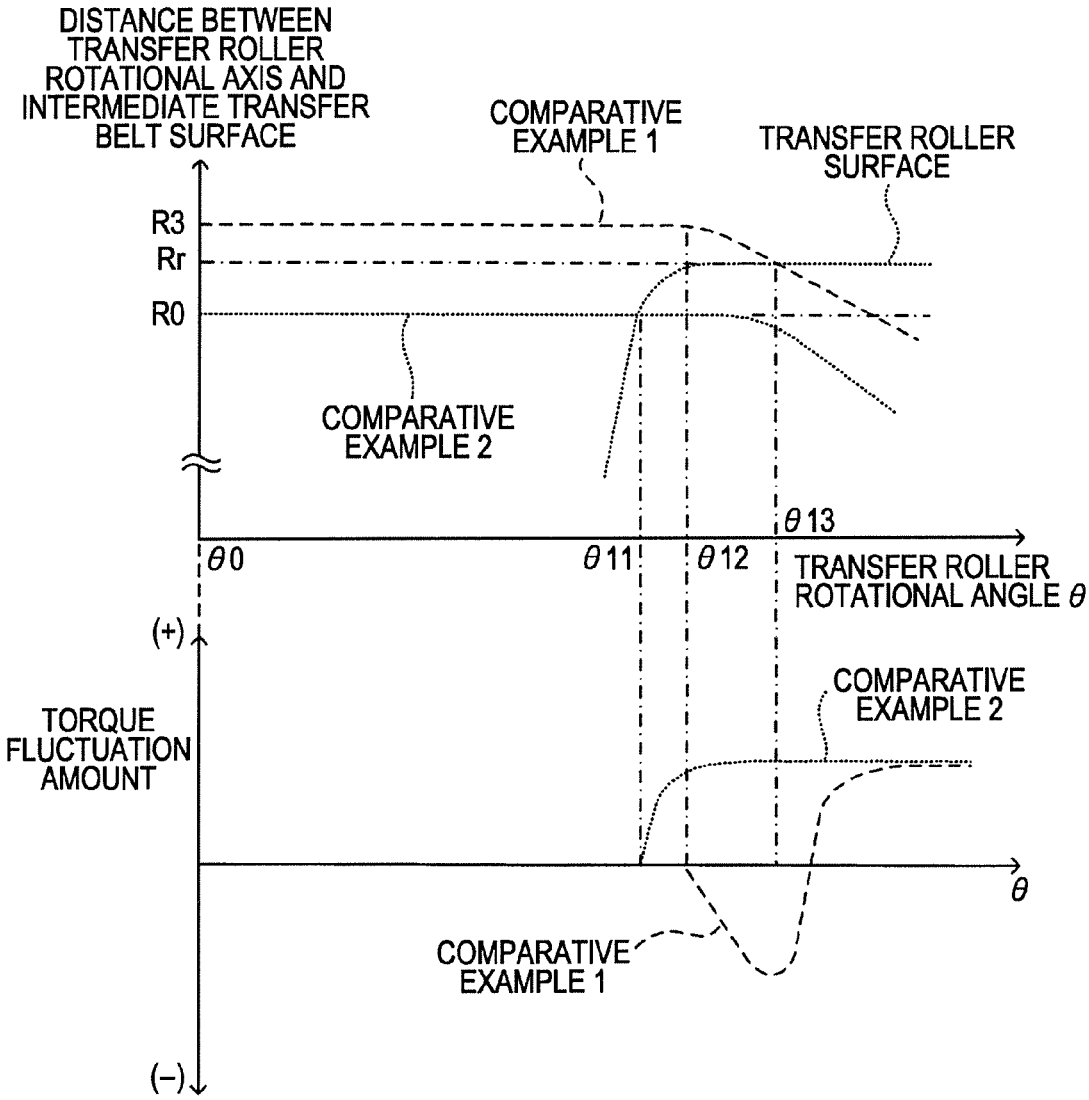
FIG. 10 is a diagram schematically illustrating torque fluctuation in comparative examples.

FIG. 10 is a diagram schematically illustrating torque fluctuation in a comparative example. In a comparative example 1, which is indicated by a broken line, the shape of the contact member 47 is set so that an interval R3 between the rotational axis 4210 and the intermediate transfer belt 31 when the concave portion 41 is facing the driving roller 32 is greater than the interval Rr from the surface of the secondary transfer roller 4 when the rotational axis 4210 and the elastic layer 43 are not being pressed, and so that the interval decreases little by little in the vicinity of right and left of an angle θ12 at which the elastic layer 43 and the intermediate transfer belt 31 begin to make contact with each other. To be more specific, the shape of the contact member is such that the vicinities of the end portions thereof are retracted more than the arc in the central portion thereof. In a case such as this, the load is lightened as the contact member 47 retracts, and thus the torque of the transfer roller driving motor M4 changes in the negative direction.

Accordingly, in a state in which the interval between the rotational axis 4210 and the intermediate transfer belt 31 gradually decreases, the elastic layer 43 and the intermediate transfer belt 31 begin to iota contact with each other at an angle θ13. At this time, the torque for pressing the elastic layer 43 is required, and thus the torque of the transfer roller driving motor M4 changes to the positive direction at once. In this manner, in the comparative example 1, the torque of the transfer roller driving motor M4 fluctuates greatly.

Meanwhile, in a comparative example 2, which is indicated by a dotted line in FIG. 10, the interval between the rotational axis 4210 and the intermediate transfer belt 31 when the concave portion 41 is facing the driving roller 32 is set so as to be the same as the interval R0 occurring when the transfer nip NP is formed. In this case, although the interval between the rotational axis 4210 and the intermediate transfer belt 31 is nearly constant, it is necessary to press the elastic layer 43 at once when contact begins to be made, and the positive-direction torque required to do so is required to the transfer roller driving motor M4.

In this manner, in these comparative examples, the torque of the transfer roller driving motor M4 fluctuates greatly in a short amount of time before and after the elastic layer 43 and the intermediate transfer belt 31 begin to make contact with each other. When the torque fluctuates suddenly in such a manner, there are cases where the control of the transfer roller driving motor M4 cannot completely track the fluctuation, leading to the occurrence of fluctuations in the speed of the secondary transfer roller 4. As opposed to this, is this embodiment, a slight torque fluctuation occurs over a comparatively long period of time before and after the elastic layer 43 and the intermediate transfer belt 31 begin to make contact with each other, and thus as long as the control of the transfer roller driving motor M4 is carried out properly so as to track the torque fluctuation, the advent of fluctuations in the speed can be avoided. This is because the cause of such speed fluctuations is not the degree of the amount of fluctuation in the torque itself, but is instead the degree of the rate of change therein.

Note that in the example in FIG. 9, the interval R between the secondary transfer roller rotational axis 4210 and the intermediate transfer belt 31 increases from an initial value R1 to a maximum value R2, and then once again decreases, converging on the interval R0 when the transfer nip NP is formed. While the interval R is increasing from the initial value R1 to the maximum value R2, the elastic layer 43 and the intermediate transfer belt 31 begin to make contact with each other. Because having the elastic layer 43 and the intermediate transfer belt 31 begin to make contact with each other when the interval decreases after the maximum value R2 has been exceeded or setting the maximum value R2 to be greater than the outer diameter Rr of the secondary transfer roller 4 have the same results as the aforementioned comparative example 1, doing so is not preferable.

Meanwhile, the configuration may be such that, for example, the interval R increases monotonically from the initial value R1 to the interval R0 occurring when the transfer nip NP is formed without taking on the maximum value R2, and the contact between the elastic layer 43 and the intermediate transfer belt 31 may begin during that increase. However, in the case where an elastic layer 43 is provided on the surface of the transfer roller 4, it is preferable, as in this embodiment, to gradually bring the interval R toward the interval R0 occurring when the transfer nip NP is formed after once increasing the interval R beyond R0, from the standpoint of adjusting the torque required to press the elastic layer 43 and preventing sudden torque fluctuations. In this case, with respect to the interval Rx occurring when contact begins to be made, there are no requirements on the size relationship with the value R0 occurring when the transfer nip NP is formed as long as the interval R is increasing. In other words, the configuration may be such that the interval Rx occurring when contact begins to be made is greater than the value R0 occurring when the transfer nip NP is formed, as in this embodiment, or may be such that the interval Rx is equal to or less than that value.

Meanwhile, as shown in FIG. 6, with the contact member 47 according to this embodiment, not only is the protruding section 47*b* provided on the following side in the rotational direction D4 of the contact member 47 (the left side in FIG. 6), or in other words, on the end portion of the side positioned at the secondary transfer location TR2 when the circumferential surface that is facing the intermediate transfer belt 31 switches from the concave portion 41 to the elastic layer 43 as the secondary transfer roller 4 rotates, but the protruding section 47*c* is also provided in the end portion on the leading side in that direction (the right side in FIG. 6). The reasons for this are as follows.

First, a first reason will be explained. When the secondary transfer roller 4 rotates further from a state in which the elastic layer 43 of the secondary transfer roller 4 makes contact with the intermediate transfer belt 31 at the secondary transfer location TR2 and the transfer nip NP is formed, and the concave portion 41 reaches the secondary transfer location TR2, the circumferential surface of the secondary transfer roller 4 that is facing the intermediate transfer belt 31 switches from the elastic layer 43 to the concave portion 41. At this time, the secondary transfer roller 5 is released from the state of contact with the intermediate transfer belt 31 and the torque required to press the elastic layer 43 is no longer necessary, and thus the torque of the transfer roller driving motor M4 decreases suddenly. In order to cancel out this torque decrease and soften torque fluctuations, it is desirable to, for example, increase the radius of the contact member 47 and increase the torque.

A second reason is as follows. In this embodiment, the interval R1 between the rotational axis 4210 and the intermediate transfer belt 31 when the concave portion 41 is located at the secondary transfer location TR2 and the transfer nip NP disappears is smaller than the interval R0 occurring when the transfer nip NP is formed. This is because the interval between the rotational axis 4210 and the intermediate transfer belt 31 is caused to increase when the transfer nip NP begins to be formed, as described above. Accordingly, when, conversely, the time when the transfer nip NP disappears is considered, the interval between the rotational axis 4210 and the intermediate transfer belt 31 decreases from R0 to R1. In other words, at that time, the rotational axis 4210 moves so as to approach the intermediate transfer belt 31. Because this movement follows the direction of the biasing force exerted by the pressure unit 45, the torque of the transfer roller driving motor M4 caused by that biasing force also decreases. It is also necessary to take separate measures in order to increase the torque so as to soften these torque fluctuations as well.

For the aforementioned reasons, in this embodiment, the side of the outer circumferential surface of the contact member 47 that first makes contact with the bearing 322, or in other words, the end on the leading side in the rotational direction D4, is also provided with the protruding section 47*c*, in which the radius gradually increases and then gradually decreases; through this, sudden fluctuations in the torque occurring when the transfer nip NP disappears are eliminated.

Figure 11:
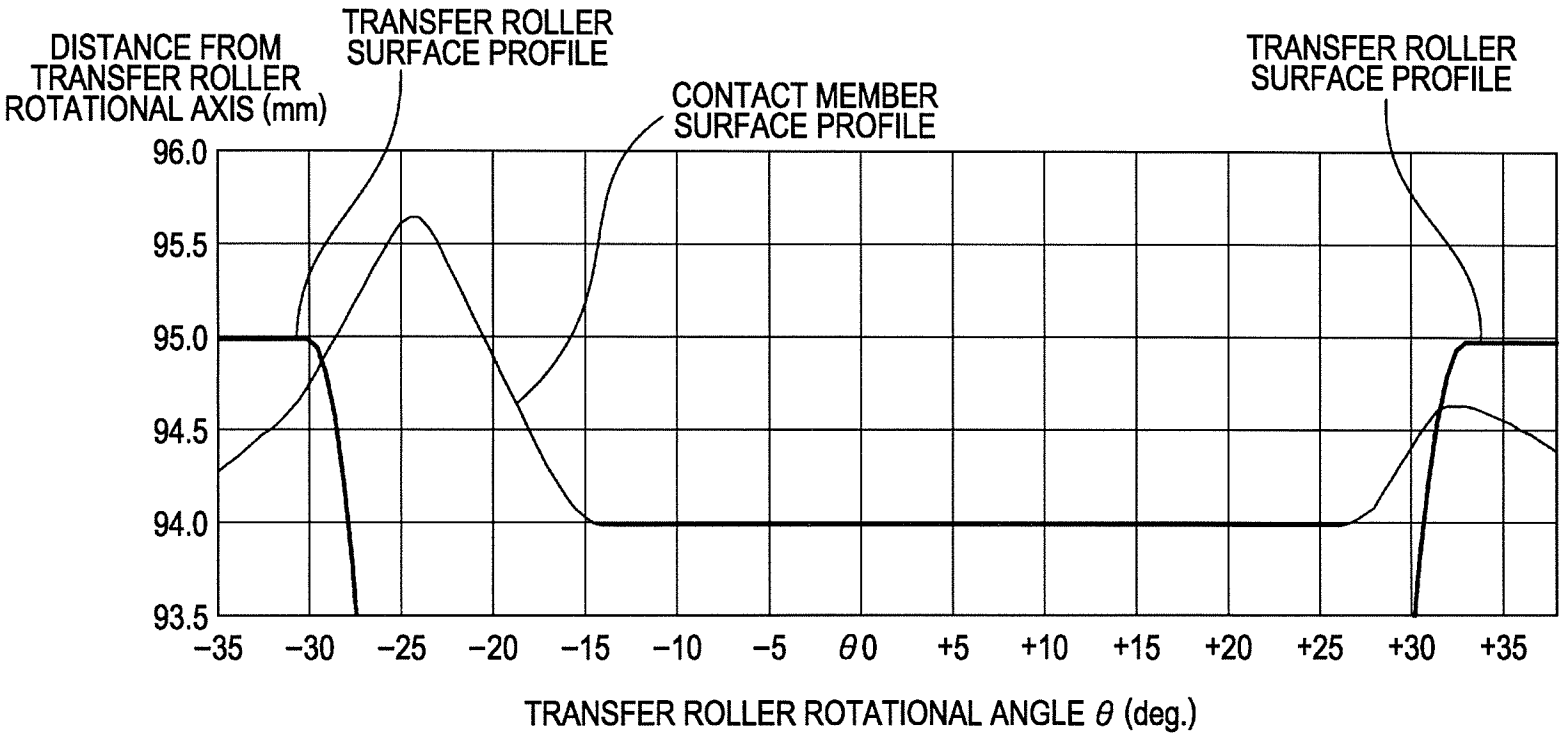
FIG. 11 is a diagram illustrating an example of the design values of the shape of the contact member according to the embodiment.

FIG. 11 is a diagram illustrating an example of the design values of the shape of the contact member 47 according to this embodiment. As shown in FIG. 11, the central portion 47*a* of the outer circumferential surface of the contact member 47 has a shape in which the distance from the rotational axis 4210 of the secondary transfer roller 4 is nearly constant, or in other words, has an arc shape. Accordingly, the shape has a profile in which the distance from the rotational axis 4210 increases at the end portions, and thus it is possible to realize movement in which the rotational axis 4210 and the surface of the intermediate transfer belt 31 gradually move away from each other when the elastic layer 43 of the secondary transfer roller 4 begins to make contact with the intermediate transfer belt 31.

As described thus far, according to this embodiment, when the surface of the secondary transfer roller 4 that is facing the driving roller 32 changes from the concave portion 41 to the elastic layer 43 at the secondary transfer location TR2, the elastic layer 43 and the intermediate transfer belt 31 come into contact with each other, and the transfer nip NP is formed, the elastic layer 43 and the intermediate transfer belt 31 start to make contact with each other while the rotational axis 4210 of the secondary transfer roller 4 is moving away from the surface of the intermediate transfer belt 31.

To be more specific, as a result of the design of the outer circumferential shape of the contact member 47, which is provided so as to wall up the concave portion 41 of the secondary transfer roller 4, the rotational axis 4210 is in a state in which it has been brought close to the intermediate transfer belt 31 when the concave portion 41 is located at the secondary transfer location TR2. Then, when the concave portion 41 has passed the secondary transfer location TR2 and the leading end of the elastic layer 43 has approached the secondary transfer location TR2, the radius of the contact member 47 increases, thus causing the interval between the rotational eras 4210 of the secondary transfer roller 4 and the intermediate transfer belt 31 to widen.

In this embodiment, it is possible, by causing the elastic layer 43 and the intermediate transfer belt 31 to begin to make contact site each other while the rotational axis 4210 and the intermediate transfer belt 31 are moved away from each other in this manner, to suppress sudden fluctuations in the torque of the transfer roller driving motor M4 at the start of the contact and reduce such fluctuations to gentle changes, thus making it possible to prevent disturbances in the image formation caused by fluctuations in the speed of the intermediate transfer belt 31 arising due to such fluctuations in the torque.

As described thus far, in this embodiment, the intermediate transfer belt 31 and the secondary transfer roller 4 function as an "image bearing member" and a "transfer roller", respectively, according to the invention. In addition, in this embodiment, the pressure unit 45 and the contact member 47 function as a "biasing member" and a "holding member", respectively, according to the invention, and these two elements function collectively as an "adjustment unit" according to the invention. Furthermore, in this embodiment, the gripping portion 44 functions as a "gripping portion" according to the invention.

Note that the invention is not limited to the aforementioned embodiment, and various modifications are possible in addition to the content described above without departing from the spirit of the invention. For example, although the secondary transfer roller 4 is configured so as to be capable of freely moving toward and away from the intermediate transfer belt 31 in the aforementioned embodiment, the same effects can in principle be achieved by the invention even if the intermediate transfer belt 31 is conversely moved relative to the secondary transfer roller 4. However, because images are formed on the intermediate transfer belt 31 at the primary transfer locations TR1 by the respective image forming stations 2Y, 2M, 2C, and 2K, it is preferable not to move the intermediate transfer belt 31 in order to prevent this image formation from being affected.

Furthermore, although four image forming stations 2Y, 2M, 2C, and 2K are, for example, arranged in a row along the direction in which the intermediate transfer belt 31 runs in the aforementioned embodiment, the number, arrangement, and the like of the image forming stations is not limited thereto. The aspect of the invention can also be applied in an image forming apparatus provided with, for example, only one image forming station.

Furthermore, in the aforementioned embodiment, the intermediate transfer belt 31, the belt driving roller 32, the secondary transfer backup roller 34, the secondary transfer roller 4, the tension rollers 33 and 35, and the like collectively configure the transfer unit 3. In this case, it is not absolutely necessary for a driving source for driving the transfer roller, the driving roller, and the like to be included in the transfer unit, and the configuration may instead be such that, for example, when the transfer unit is installed, a motor anchored to the image forming apparatus itself functions as the driving source by linking with the transfer roller, the driving roller, and the like.

Furthermore, although the image forming apparatus 1 in the aforementioned embodiment is a so-called liquid developer-type image forming apparatus that uses a developer in which toner is dispersed throughout a liquid carrier, the invention is not limited to application in apparatuses of only this type. In other words, the aspect of the invention can be applied in all image forming apparatuses and transfer apparatuses that have, as illustrated in FIG. 1, a structure in which a transfer roller that has a surface shape in which part of the cylindrical circumferential surface has been cut out is brought into contact with an intermediate transfer belt, regardless of the developing type.

Furthermore, the aspect of the invention can also be applied in an apparatus that includes a transfer roller that does not have a gripping portion. With, for example, an apparatus in which a surface layer is configured by winding a sheet-shaped elastic member upon the surface of a transfer roller, it is necessary to provide a concave portion in the outer circumferential surface of the transfer roller in order to anchor the end portion of the sheet; however, the aspect of the invention can be applied in apparatuses that do have such a configuration (a concave portion) but do not have a gripping portion.

The entire disclosure of Japanese Patent Application No: 2009-233500, filed Oct. 7, 2009 is expressly incorporated by reference herein.

What is claimed is:

1. An image forming apparatus comprising:

an image bearing member that bears an image; and a transfer roller, having a concave portion in its circumferential surface and rotating central to a rotational axis, whose circumferential surface aside from the concave portion makes contact with the image bearing member and transfers the image onto a recording material, wherein the circumferential surface of the transfer roller aside from the concave portion makes contact with the image bearing member due to rotation of the transfer roller while the rotational axis of the transfer roller moves away from the image bearing member.

2. The image forming apparatus according to claim 1, further comprising an adjustment unit that moves the rotational axis closer to or away from the image bearing member.

3. The image forming apparatus according to claim 2, wherein the adjustment unit includes a biasing member that biases the transfer roller toward the image bearing member and a holding member that holds distance between the rotational axis and the image bearing member against bias exerted by the biasing member.

4. The image forming apparatus according to claim 1, wherein a distance between the rotational axis and the image bearing member when the circumferential surface of the transfer roller aside from the concave portion makes contact with the image bearing member due to the rotation of the transfer roller is greater than a distance between the rotational axis and the image bearing member when the concave portion is facing the image bearing member.

5. The image forming apparatus according to claim 4, wherein the distance between the rotational axis and the image bearing member when the circumferential surface of the transfer roller aside from the concave portion makes contact with the image bearing member due to the rotation of t he transfer roller is less than a distance between the rotational axis and the image bearing member when the circumferential surface of the transfer roller aside from the concave portion has made contact with the image bearing member and rotated for a predetermined amount of time.

6. The image forming apparatus according to claim 4, wherein a distance between the rotational axis and the image bearing member becomes maximum after the transfer roller and the image bearing member have made contact with each other, and the distance between the rotational axis and the image bearing member decreases with the rotation of the transfer roller after the distance between the rotational axis and the image bearing member has become maximum.

7. The image forming apparatus according to claim 1, wherein a gripping portion that grips a recording material is provided in the concave portion.

8. An image forming method comprising:

causing an image to be borne on an image bearing member;

rotating, central to a rotational axis, a transfer roller having a concave portion in its circumferential surface and whose circumferential surface aside from the concave portion makes contact with the image bearing member; and moving the rotational axis of the transfer roller away from the image bearing member when rotation of the transfer roller causes the concave portion to move from a location in which the concave portion faces the image bearing member and the circumferential surface of the transfer roller aside from the concave portion makes contact with the image bearing member.

* * * * *